US006080464A

United States Patent [19]

Gampe et al.

[11] Patent Number: 6,080,464

[45] Date of Patent: Jun. 27, 2000

[54] REFLECTOR FOR A RADIATING LUMINOUS SOURCE AND USE OF THE SAME

[75] Inventors: Uwe Gampe, Floersheim; Stefan Greif, Fulda; Jörg Eduard Hartge, Geinhausen, all of Germany

[73] Assignee: Heraeus Med GmbH, Hanau, Germany

[21] Appl. No.: 09/082,164

[22] Filed: May 20, 1998

Related U.S. Application Data

[63] Continuation-in-part of application No. 08/729,038, Oct. 10, 1996, abandoned.

[30] Foreign Application Priority Data

Nov. 20, 1995 [DE] Germany ..... 195 43 005

[51] Int. Cl.[7] ..... F21V 7/22

[52] U.S. Cl. ..... 428/131; 428/215; 428/411.1; 428/469; 428/450; 428/156; 428/44; 428/46; 362/296; 362/297; 362/299; 362/300; 362/346

[58] Field of Search ..... 428/131, 215, 428/411.1, 469, 450, 156, 44, 46; 362/296, 297, 299, 300, 346

[56] References Cited

U.S. PATENT DOCUMENTS

| | | | |
|---|---|---|---|
| 3,511,983 | 5/1970 | Dorman | 362/297 |
| 4,021,659 | 5/1977 | Wiley | 240/41.36 |
| 4,072,856 | 2/1978 | Eligehausen | 362/2 |
| 4,112,483 | 9/1978 | Small, Jr. et al. | 362/298 |
| 4,545,000 | 10/1985 | Fraley et al. | 362/304 |
| 4,689,519 | 8/1987 | Ooms et al. | 313/112 |
| 5,160,199 | 11/1992 | Berti | 362/346 |
| 5,272,408 | 12/1993 | Levin et al. | 313/113 |
| 5,568,967 | 10/1996 | Sikkens et al. | 362/328 |
| 5,757,113 | 5/1998 | Binder et al. | 313/114 |

FOREIGN PATENT DOCUMENTS

| | | |
|---|---|---|
| 25 35 174 | 2/1977 | Germany . |
| 26 04 921 | 9/1977 | Germany . |
| 89 06 325 | 12/1989 | Germany . |
| 2 229 264 | 9/1990 | United Kingdom . |

*Primary Examiner*—William P. Watkins, III
*Attorney, Agent, or Firm*—Frishauf, Holtz, Goodman, Langer & Chick, P.C.

[57] ABSTRACT

A reflector for a medical luminaire, for use with an incandescent bulb or a discharge bulb, which includes a reflector blank having a reflecting surface, the reflecting surface being provided with a plurality of trapezoidal facets tapering toward the point of intersection with the axis of rotation, the facets being arrayed on at least 8 circular rings around an axis of rotation of the reflector and at least 50 facets being provided in each circular ring.

17 Claims, 1 Drawing Sheet

REFLECTOR FOR A RADIATING LUMINOUS SOURCE AND USE OF THE SAME

This application is a continuation-in-part application of application Ser. No. 08/729,038, filed Oct. 10, 1996 abandoned, the entire contents of which are hereby incorporated by reference.

BACKGROUND OF THE INVENTION

1. Field of the Invention

The present invention relates to a rotationally symmetric reflector for use with an incandescent bulb or a discharge bulb, especially a halogen bulb, with a concave reflecting surface of metal, comprising a plurality of plane facets.

2. Background Information

U.S. Pat. No. 5,568,967 describes a concave reflector with a plurality of plane facets, designed to project a rectangular field; because of gaps in the array of facets, optimal efficiency is not possible.

U.S. Pat. 3,511,983 describes a further reflector array with a facet-like configuration of a concave reflector surface.

DE 25 35 174 A1 describes a reflector for selective radiating luminous sources, such as bulbs whose spectrum consists of individual lines or a few narrow bands, wherein the reflector comprises a material of high reflectance and is provided with a protective coating which is devised in such a manner that the interference colors created by the protective coating mix to a white light and unpleasant color effects in the diffused light, which can occur in a line spectrum, are prevented.

The use of such known reflectors has proved to be problematic when they are supposed to function as cold mirrors, in which color conversion toward short-wave light takes place, and given components of the spectrum, such as components of the infrared spectrum and also components of the red spectrum, are to be absorbed, since the mirror of DE 25 35 174 A1 also reflects the red and infrared components respectively of the generated radiation.

U.S. Pat. No. 4,072,856 describes a further reflector array with an interference filter coating.

SUMMARY OF THE INVENTION

One object of the present invention is to achieve a rotationally symmetric luminous field of high intensity for operating-room and medical examination luminaires, wherein undesired spectral components such as infrared radiation (heat) or even red-light components, especially of thermal radiators, for example, halogen incandescent bulbs, are minimized and simultaneously high color rendering and good color quality (white light) are obtained. Further objects are to retain the heat associated with the radiation in the luminaire housing and if necessary to remove the heat associated with the radiation by means of convective and radiative dissipation via the luminaire housing.

Another object of the present invention is to minimize production of shadows by the surgeon's body parts (such as the surgeon's head or hands) or instruments that may be in the path of the rays. In addition, the light must have a rotationally symmetric and bell-shaped distribution (Gaussian distribution) in a convergent light beam.

The above objects are achieved by providing a reflecting surface at least approximately with trapezoidal facets tapering toward the point of intersection with the axis of rotation, the facets being arrayed on at least 8 circular rings around the axis of rotation and at least 50 facets being provided in each circular ring.

BRIEF DESCRIPTION OF THE DRAWINGS

For the purposes of illustrating the present invention, there is shown in the drawings forms which are presently preferred. It is to be understood, however, that the present invention is not limited to the precise arrangements and instrumentalities depicted in the drawings.

DETAILED DESCRIPTION OF THE INVENTION

In one advantageous embodiment of the present invention, the facets are much larger on average in any direction than the dimension of the radiation source (such as an incandescent filament or a discharge gap).

In a particularly advantageous embodiment of the present invention, each facet illuminates an at least approximately trapezoidal field in the illumination plane almost uniformly, and so no real image of the radiation source exists; by a rotationally symmetric array of a plurality of facets in each ring around the optical axis, almost complete rotational symmetry of the light distribution is advantageously obtained.

In an advantageous embodiment of the reflector of the present invention, the facet position conforms approximately to the surface of a hollow ellipsoid.

Another advantage of the present invention is that the reflector can be easily manufactured by a simple stamping or pressing process with low tool costs.

In a specific use of the present invention, the reflector is utilized in a luminaire for medical applications equipped with a. radiation source.

It has proved particularly advantageous to configure the interference filter such that it acts as an infrared antireflective coating of the metal surface, allowing undesired radiation to penetrate in the form of heat into the surface.

In another advantageous embodiment of the invention, the coating layer applied onto the surface and the top coating layer of the interference coating comprise silicon dioxide.

One advantageous use is in a luminaire for medical applications, especially operating-room luminaires, since the weight of the reflector is much less than the weight of a glass reflector.

Another advantage is that no losses due to additional filter plates (absorption, reflection) occur; furthermore, no losses are caused by undesired diffusion of the type which is unavoidable with normal diffusion plates ("frosted glass plates"). Exact adaptation of the light distribution is possible. Each point of the luminous field is illuminated by a plurality of facets, thus allowing good diffuse radiation, by-passing the head, hands and instruments of the surgeon.

The subject matter of the invention will be explained in more detail hereinafter with reference to FIGS. 1, 2 and 3.

Figure 1:
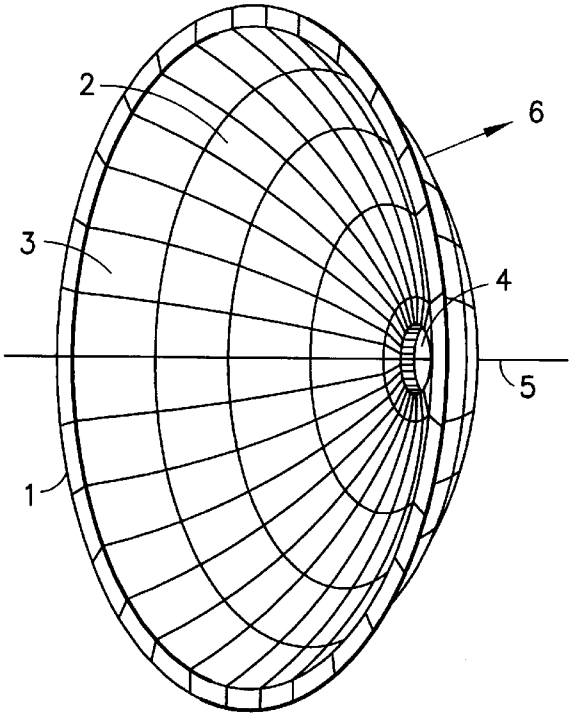
FIG. 1 is a perspective view which shows a practical example of a reflector whose reflecting interior surface is configured as part of the surface of an ellipsoid.
Figure 2:
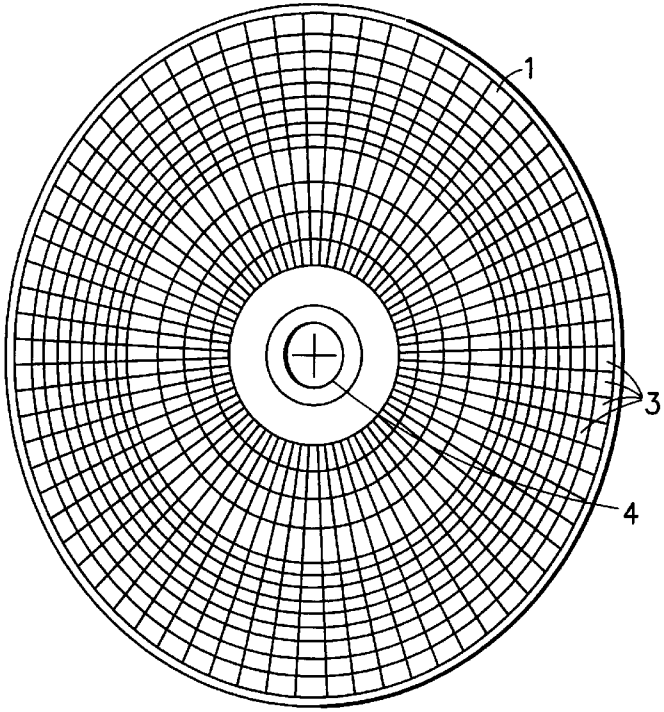
FIG. 2 is a top plan view of the inner part of the reflector according to FIG. 1.

As shown in FIG. 1, the inner reflecting surface 2 of reflector 1 includes a plurality of plane facets 3 in the form of a grid extending in a radial manner from the opening 4 for the light source, which facets provide for largely shadow-free and uniform illumination of the illuminated field, due to the fact that each facet illuminates a large part of the surgery area or illumination field. Each facet 3 illuminates an approximately trapezoidal area in the illumination plane almost uniformly, meaning that no real image of the light source exists.

By the rotationally symmetric array of a large number of facets 3 around the optical axis 5, there is obtained an almost completely rotationally symmetric light distribution.

The angle of the facets 3 relative to the optical axis 5 determines the radial distance from the surface or illumination plane illuminated by the facets 3. The radial light distribution is adjusted by superposing a plurality of rings of facets 3 with different diameters and widths. This can be achieved according to a quasi-continuous bell curve (Gaussian distribution), since a large number of at least 8 rings containing facets 3 is provided. The grid of facets 3 extending in a radial manner from the opening 4 is clearly seen in FIG. 2.

Figure 3:
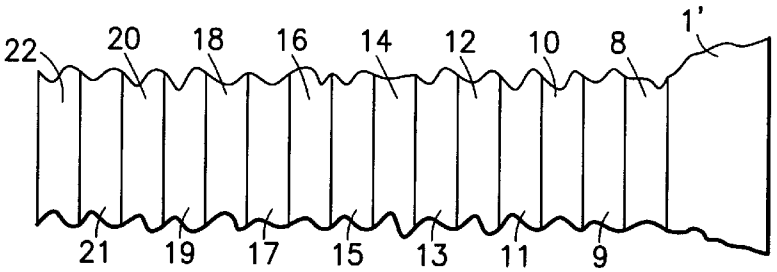
FIG. 3 is a schematic diagram which exemplifies a sequence of coating layers on the reflecting surface of the reflector according to FIG. 1 or FIG. 2.

As can be seen in FIG. 3, a plurality of coating layers is applied on the reflector blank 1' of aluminum; it is possible, however, to use stainless steel. These coating layers comprise an alternating sequence of high-refractive material and a low-refractive material. At least one of these coating layers preferably comprises a metal coating layer. The coating layer sequence of a low-refractive material and a high-refractive material can be repeated several times, although a sequence beginning with a high-refractive coating layer on the metal and only then continuing with a low-refractive coating layer is also possible. The outer top coating layer 22 comprises substantially silicon dioxide and serves as a protective coating against mechanical or even chemical corrosion of the reflector surface. The basic principle of such a coating (interference filter) is known from U.S. Pat. No. 4,689,519, the entire contents of which are hereby incorporated by reference.

The thickness of the individual coating layers ranges from 50 nm to 2000 nm, whereby incident light with wavelengths of 400 nm and longer is absorbed by the reflector 1, the absorption becoming greater as the wavelength becomes longer, so that the radiation components of the red and infrared spectrum are attenuated and an overall shift of the visible spectrum toward shorter wavelengths, namely into the blue region, takes place. The long-wave spectra (red, infrared) absorbed by the reflector 1 are converted through absorption in reflector 1 into heat which, by means of radiation and convection, is removed in the direction facing away from the reflector opening 4, as shown by 6 in FIG. 1. A reflector axis 5 passes through the opening 4.

Based on the particular configuration of the interference filter comprising coating layers of titanium dioxide and silicon dioxide, the heat associated with the radiation is removed from the reflector 1 in direction 6, by thermal radiation or convection to the rearward portion of the luminaire housing.

In the practical embodiment shown in FIG. 3, fifteen (15) coating layers 8 through 22 in total are applied on the aluminum reflector blank 1'. Coating layers 8, 10, 12, 14, 16, 18, 20 and 22, which comprise silicon dioxide, alternate respectively with coating layers 9, 11, 13, 15, 17, 19 and 21, which comprise titanium dioxide. In order to improve the absorption of undesired radiation through the reflector, an absorbing metal can be embedded between the boundary surfaces of the coating layers or in the coating layers themselves, preferably in the interior coating layers. Aluminum, for example, can be employed as an absorbing metal.

Thus it is possible to provide a luminaire with a reflector which, in comparison to glass reflectors, is very lightweight in construction. In a preferred embodiment, the absorption maximum occurs at a wavelength of 700 to 750 nm and the absorption exceeds 50% in the near infrared, allowing light which is largely free of thermal radiation to be used preferentially in a medical luminaire or operating-room luminaire. Especially for operating-room luminaires, the use of relatively lightweight reflectors of aluminum is particularly advantageous, since the problems occurring in connection with adjusting the angle of emission and/or setting the angle of illumination can be regulated by the surgeon using only slight force due to the low mass.

In practice, the coating layer structure shown in FIG. 3 will be made to conform to the reflector curvature which, however, is not illustrated in the detail therein.

It will be appreciated that the instant specification is set forth by way of illustration and not limitation, and that various modifications and changes may be made without departing from the spirit and scope of the present invention

What is claimed is:

1. A reflector for a medical luminaire, for use with an incandescent bulb or a discharge bulb, which comprises a reflector blank formed of metal and having a reflecting surface and an interference coating being disposed directly on the reflecting surface, the interference coating comprising a plurality of individual coating layers being selected from the group consisting of metal oxide coating layers and metal coating layers, the plurality of individual coating layers comprising alternative coating layers of high-refractive coating layers and low-refractive coating layers, wherein at least one of said plurality of individual coating layers is a metal coating layer, each individual interference coating layer having a thickness of 0.05 $\mu$m to 2 $\mu$m, and the reflecting surface having a plurality of trapezoidal facets tapering toward the point of intersection with the axis of rotation, the facets being arrayed on at least 8 circular rings around an axis of rotation of the reflector and at least 50 facets being provided in each circular ring.

2. The reflector according to claim 1, wherein the plurality of facets are arrayed substantially in the form of a hollow ellipsoid or paraboloid.

3. The reflector according to claim 1, wherein the reflecting surface comprises substantially aluminum.

4. The reflector according to claim 1, wherein the coating layer deposited on the reflecting surface comprises titanium dioxide.

5. The reflector according to claim 4, wherein the coating layer deposited on the reflecting surface comprises silicon dioxide.

6. The reflector according to claim 1 wherein the metal coating layer comprises aluminum.

7. The reflector according to claim 1, wherein the top coating layer of the interference coating comprises silicon dioxide.

8. The reflector according to claim 1, wherein the reflector absorbs impinging light starting at 400 nm.

9. The reflector according to claim 8, wherein the reflector has a maximum absorption at a wavelength of 700 to 750 nm and the absorption exceeds 50% in the near infrared.

10. A combination of a reflector and a bulb comprising:

a reflector according to claim 1, and further comprising a centrally located aperture therein for accommodating a bulb, and a bulb disposed in the centrally located aperture.

11. The combination of a reflector and a bulb according to claim 10, wherein the bulb is an incandescent bulb having a filament.

12. The combination of a reflector and a bulb according to claim 11, wherein the shortest side of each facet is longer than the length of the filament of the incandescent bulb.

13. The combination of a reflector and a bulb according to claim 10, wherein the bulb is a discharge bulb having a pair of electrodes.

14. The combination of a reflector and a bulb according to claim 13, wherein the shortest side of each facet is longer than the spacing between the electrodes of the discharge bulb.

15. The combination of a reflector and a bulb according to claim 10, wherein the bulb is a halogen bulb with a concave reflecting surface.

16. The combination of a reflector and a bulb according to claim 10, wherein the bulb is for an operating room luminaire.

17. A reflector for a medical luminaire, for use with an incandescent bulb or a discharge bulb, which consists essentially of a reflector blank formed of metal and having a reflecting surface and an interference coating being disposed directly on the reflecting surface, the interference coating consists essentially of a plurality of individual coating layers being selected from the group consisting of metal oxide coating layers and metal coating layers, the plurality of individual coating layers consists essentially of alternative coating layers of high-refractive coating layers and low-refractive coating layers, wherein at least one of said plurality of individual coating layers is a metal coating layer, each individual interference coating layer having a thickness of 0.05 $\mu$m to 2 $\mu$m, and the reflecting surface having a plurality of trapezoidal facets tapering toward the point of intersection with the axis of rotation, the facets being arrayed on at least 8 circular rings around an axis of rotation of the reflector and at least 50 facets being provided in each circular ring.

* * * * *